US005701129A

United States Patent [19]

Itou et al.

[11] Patent Number: 5,701,129

[45] Date of Patent: Dec. 23, 1997

[54] HELICAL ANTENNA WITH INTEGRAL J-SHAPED IMPEDANCE AND MOUNTING ELEMENT AND DUAL PART COVER

[75] Inventors: Toshifumi Itou, Umi-machi; Hiromitsu Shimazaki, Honami-machi; Masaaki Arita, Oonojou; Shougo Horinouchi, Fukuoka, all of Japan

[73] Assignee: Matsushita Electric Industrial Co., Ltd., Osaka, Japan

[21] Appl. No.: 392,161

[22] Filed: Feb. 22, 1995

[30] Foreign Application Priority Data

Feb. 28, 1994 [JP] Japan ..... 6-029580

[51] Int. Cl.[6] ..... H01Q 1/40; H01Q 11/08

[52] U.S. Cl. ..... 343/873; 343/895

[58] Field of Search ..... 343/749, 873, 343/895, 900, 702; H01Q 9/00, 1/36, 1/40, 11/08

[56] References Cited

U.S. PATENT DOCUMENTS

| | | | |
|---|---|---|---|
| 3,828,353 | 8/1974 | Majkrzak et al. | 343/873 |
| 4,169,267 | 9/1979 | Wong et al. | 343/895 |
| 4,435,713 | 3/1984 | Gasparaitis et al. | 343/702 |
| 4,435,716 | 3/1984 | Zandbergen | 343/895 |
| 4,725,395 | 2/1988 | Gasparaitis et al. | 264/250 |
| 4,742,359 | 5/1988 | Ishino et al. | 343/895 |
| 5,134,422 | 7/1992 | Auriol | 343/895 |
| 5,216,436 | 6/1993 | Hall et al. | 343/895 |
| 5,479,182 | 12/1995 | Sydor | 343/895 |

FOREIGN PATENT DOCUMENTS

| | | |
|---|---|---|
| H 1-126711 | 8/1989 | Japan . |
| 0720114 | 12/1954 | United Kingdom . |
| 2255449 | 11/1992 | United Kingdom . |

OTHER PUBLICATIONS

The ARRL Antenna Book, published by the American Radio Relay League, Newington, CT, 15th Ed., 1988, pp. 16–21 to 16–25.

*Primary Examiner*—Michael C. Wimer
*Attorney, Agent, or Firm*—McDermott, Will & Emery

[57] ABSTRACT

An antenna element is composed by molding with an armor, and therefore if a slight deformation is caused by external force, the antenna characteristics are hardly changed. In particular, by the helicoid constitution of the antenna, changes of the pitch of antenna element and coil length are small, so that an antenna of excellent characteristics may be obtained. Moreover, by forming a hollow part in the armor and holding part of the helicoid part by the armor, more excellent antenna characteristics may be obtained.

2 Claims, 13 Drawing Sheets

HELICAL ANTENNA WITH INTEGRAL J-SHAPED IMPEDANCE AND MOUNTING ELEMENT AND DUAL PART COVER

BACKGROUND OF THE INVENTION

The present invention relates to an antenna and a radiotelephone used in communication equipment and the like.

FIGS. 13*a* and 13*b* are a longitudinal sectional view and lateral sectional view showing, respectively, a conventional helical antenna.

In FIG. 13*a* and FIG. 13*b*, the helical antenna is composed of an antenna element 4, a connector 1, and a cover 5.

The connector 1 has a large-diameter part 2, and a small-diameter part 3 provided at the front end of the large-diameter part 2. The antenna element 4 is made of a wire which is processed in a helical form, and the antenna element 4 is inserted into the small-diameter part 3. The cover 5 is provided to cover the antenna element 4, and this cover 5 is a cylindrical form closed at one opening.

In such a constituted helical antenna, the natural frequency was adjusted by controlling the diameter of the wire for composing the antenna element 4, and the coil pitch, coil diameter, and length of the antenna element 4.

In such a conventional constitution, however, since the antenna element 4 is provided as being screwed into the connector 1, the coil pitch of the antenna element 4 may be changed, which causes the natural frequency of the antenna to change itself.

After installing the antenna in the communication equipment, by deflecting the antenna, the coil pitch or other condition of the antenna element 4 may be changed, which also results in a change of natural frequency.

SUMMARY OF THE INVENTION

The antenna of the invention comprises an antenna element and an armor for covering the antenna element, and at least part of the antenna element is held in the armor.

In this constitution, fluctuations of natural frequency are small, and an antenna having a stable antenna characteristic is obtained.

A radiotelephone of the invention comprises:

(1) an antenna comprising an antenna element and an armor for covering the antenna element, with at least part of the antenna element being held in the armor, (2) a transmitter for converting an input signal into a send signal, (3) a receiver for converting a received signal into an output signal, and (4) a controller for controlling the receiver and transmitter.

In this constitution, a radiotelephone producing a less noisy voice is obtained.

DESCRIPTION OF THE PREFERRED EMBODIMENTS

Embodiment 1

Figure 1A:
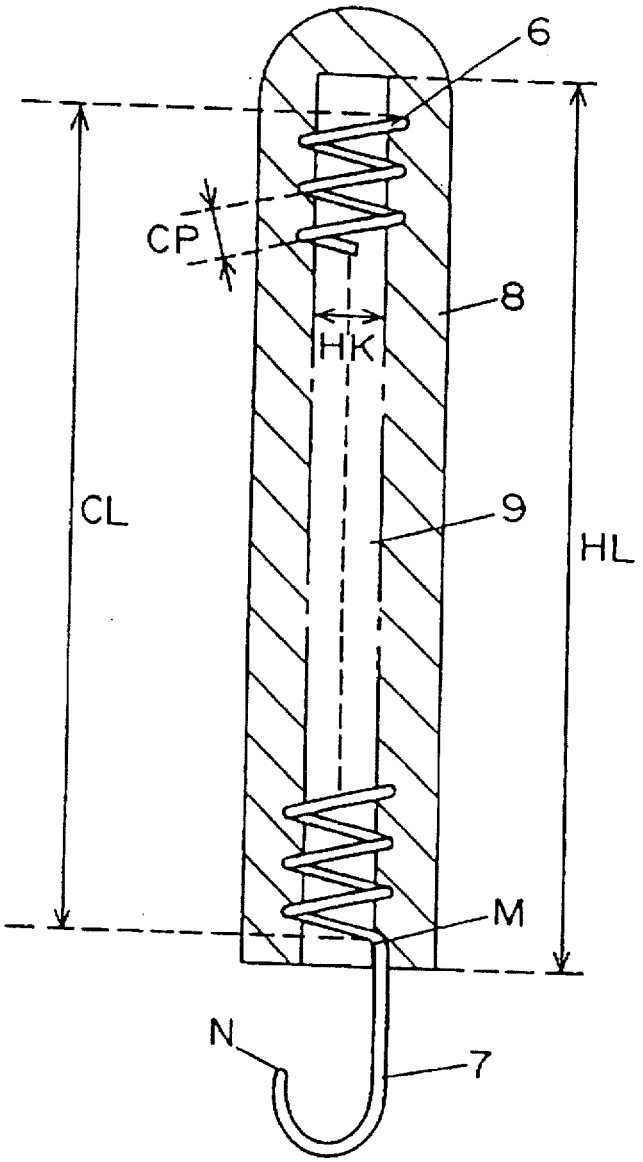
FIG. 1*a* is a longitudinal sectional view of a first embodiment of an antenna of the invention.
Figure 1B:
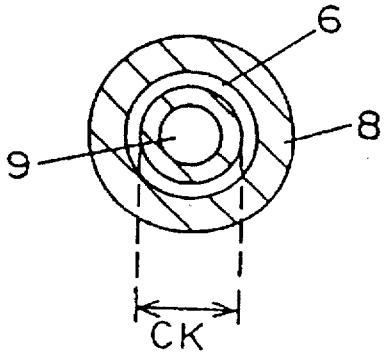
FIG. 1*b* is a lateral sectional view of the antenna in FIG. 1*a*.

FIG. 1*a* and FIG. 1*b* are a longitudinal sectional view and a lateral sectional view, respectively, showing an antenna in a first embodiment of the invention. In FIG. 1*a* and FIG. 1*b*, the antenna comprises an antenna element 6, and an armor 8 provided to cover the antenna element 6. The antenna element 6 has a slender, helically wound helicoid part and a hook part 7. A hole 9 is formed in the armor 8 as a hollow part. The helicoid part of the antenna element 6 is fixed on the armor 8 so as to surround the hole 9. The antenna element 6 is formed by processing a conductive wire in a helical form. The wire for forming the antenna element 6 is, for example, stainless steel wire (e.g. SUS301, SUS02), copper wire, or iron wire (in particular, hard steel wire adding carbon to Fe). When stainless steel wire is used as the wire material, corrosion resistance is excellent, and hence, the antenna characteristic does not deteriorate if used for a long period. When using a copper wire, it excels in processability, and it is easy to process so that the productivity is enhanced. When using iron wire (in particular, hard steel wire adding carbon to Fe), by processing helically, the elasticity of the antenna element 6 itself is increased, and deformation of antenna element 6 hardly occurs in the manufacturing process, so that fluctuations of antenna characteristics, such as natural frequency, may be suppressed.

The natural frequency of the antenna can be adjusted by controlling the coil pitch (CP), coil length (CL) or coil diameter (CK) of the helicoid part of the antenna element 6.

The input impedance can be adjusted by controlling the length of the hook part 7 of the antenna element 6. Herein, the length of the hook part 7 is the length from the coil end (M) to the hook front (N). A specific length (M) of a conductive which can be pre-shaped into the form of a J as hook part 7, as shown in FIG. 1*a*. By pre-shaping the hook part 7, the input impedance of the antenna element 6 can be kept constant. As a result, fluctuations in the input impedance portion of the antenna 6 can be controlled.

The armor 8 fixes part of the antenna element 6. In FIG. 1*a*, the outside part of the helicoid part of the antenna element 6 is molded in the armor 8, and is held by the armor 8. The armor 8 is nonconductive, and is composed of an elastic material. For example, the armor 8 is formed of a resin material, such as polyester derivative elastomer, ketone derivative resin, and polysulfone derivative resin. When polyester derivative elastomer is used as the armor 8, migration after forming (migration of material components in the contact interface) is small; it does not adhere to another member; it is excellent in stability, and further, it is superior in mechanical strength. When ketone derivative resin is used as the armor 8, the heat resistance is high, and it is ideal for the antenna when used at high temperature. When polysulfone derivative resin is used as the armor 8, it excels in stability and the mechanical strength is great.

The armor 8 is formed, for example, by pouring the resin into the outer circumference of the helicoid part of the antenna element 6, and molding.

The bending strength of the antenna can be adjusted by controlling the length (HL) and diameter (HK) of the hole 9 provided in the armor 8. For example, by shortening the length (HL) and decreasing the diameter (HK) of the hole 9, the antenna is less likely to be bent.

Thus, by covering the outer circumference of the helicoid part of the antenna element 6 with the armor 8, it is effective to decrease the characteristic change of the antenna element. In particular, by covering with an elastic armor 8, if the antenna main body is deflected by external force or a strong impact is applied, it is effective to suppress changes of the antenna characteristic. That is, if the antenna element 6 is deformed slightly by deflecting the antenna or applying a strong impact, since the antenna element 6 is fixed by the armor 8 which is hardly deformed, and therefore even after deflection is cleared, the coil pitch (CP) and other dimensions of the antenna element 6 are not changed, so that the characteristic is not changed.

Figure 13A:
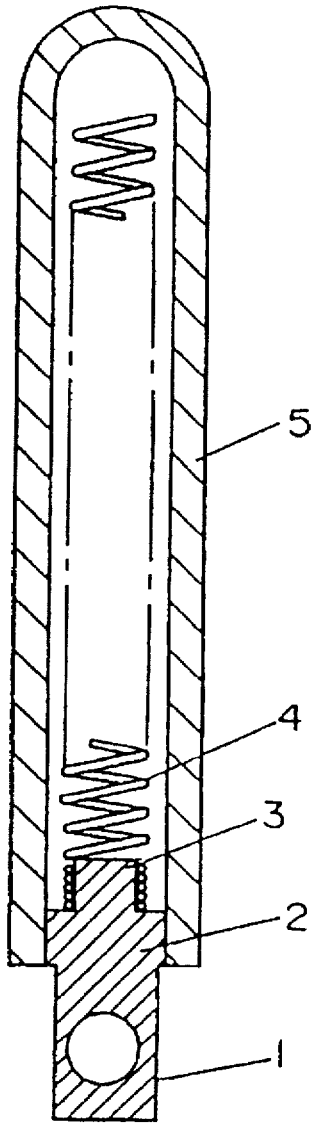
Fig. 13a Prior art
FIG. 13*a* is a longitudinal sectional view showing a conventional antenna.
Figure 13B:
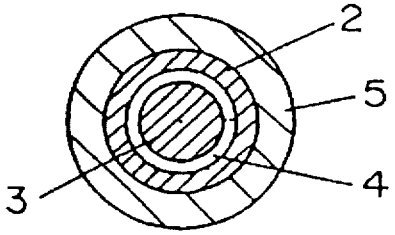
Fig. 13b Prior art
FIG. 13*b* is a lateral sectional view of FIG. 13*a*.

By contrast, in the case of the conventional antenna shown in FIG. 13*a* and FIG. 13*b*, when the antenna is deflected, the antenna element 4 itself is deformed, and the antenna characteristic may be changed.

Besides, since the armor 8 is constituted so as to cover the helicoid part of the antenna element 6, corrosion of antenna element 6 by water and deterioration by light are prevented, and the weather resistance is enhanced, so that deterioration of antenna characteristic can be prevented if used for a long time.

In the embodiment, moreover, since the number of parts is decreased as compared with the prior art, the cost is lowered, and the productivity is improved.

Meanwhile, in the embodiment, the shape of the armor 8 is columnar, and its sectional shape is circular. The circular section is effective to prevent cutting of the outside part of the armor. The sectional shape of the armor 8 may be also triangular, quadrangular, polygonal, or elliptical. In the case of triangular, quadrangular or polygonal section, the antenna hardly rolls on a plane, and it is convenient for use, and hence, the productivity is enhanced. By forming the armor 8 in an elliptical section, the antenna hardly rolls, and cut of the corner is prevented.

In the embodiment, the outer circumference of the helicoid part of the antenna element 6 is fixed to the armor 8. As an alternate, part of the helicoid part may be fixed on the armor 8. For example, the middle portion of the helicoid part of the antenna element 6 that is most likely to be deflected may be fixed by the armor 8, while the both ends of the helicoid part may not be fixed. Or the helicoid part may be fixed on the armor 8 at every specific angle along the axial direction of the antenna element 6. When the helicoid part 6 is fixed on the armor 8 along the axial direction of the antenna element 6 at, say, every 120 degrees, the antenna element 6 is substantially fixed on the armor 8 at three positions.

Embodiment 2

Figure 2A:
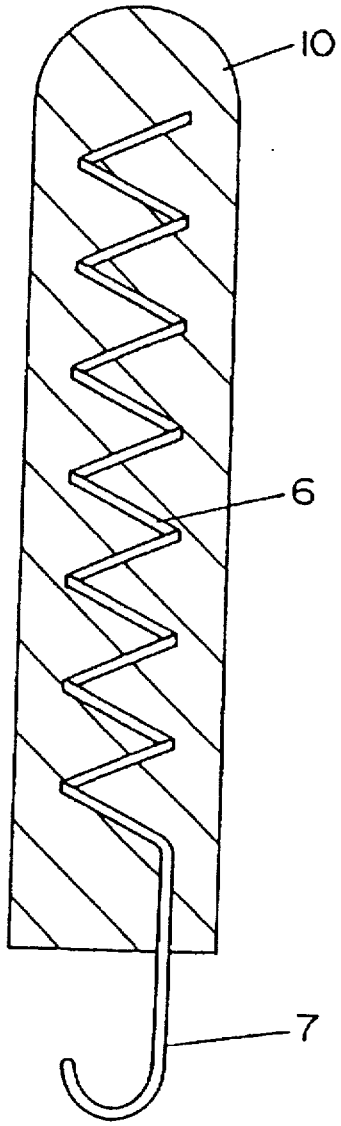
FIG. 2*a* is a longitudinal sectional view of a second embodiment of an antenna of the invention.
Figure 2B:
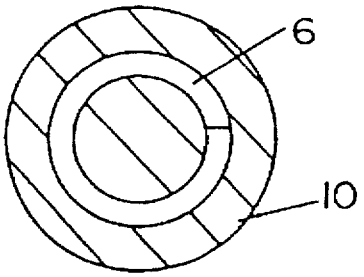
FIG. 2*b* is a lateral sectional view of FIG. 2*a*.

FIG. 2*a* and FIG. 2*b* are a longitudinal sectional view and a lateral sectional view, respectively, showing an antenna in a second embodiment of the invention. In FIG. 2*a* and FIG. 2*b*, the antenna comprises an antenna element 6, and an armor 8 provided to cover the antenna element 6. The antenna element 6 has a helically wound helicoid part and a hook part 7, and is the same as used in embodiment 1.

An armor 10 fixes the outer circumference of the helicoid part of the antenna element 6. The armor 10 is nonconductive, and comprises an elastic material. For example, the armor 8 can be formed of a resin material, such as polyester derivative elastomer, ketone derivative resin, and polysulfone derivative resin. When polyester derivative elastomer is used as the armor 8, migration after forming is small; it does not adhere to other member; it is excellent in stability; and further, it is superior in mechanical strength. When ketone derivative resin is used as the armor 8, the heat resistance is high, and it is ideal for the antenna when used at high temperature. When polysulfone derivative resin is used as the armor 8, it excels in stability and the mechanical strength is great.

The armor 8 is formed, for example, by pouring the resin into the outer circumference of the antenna element 6, and molding.

The difference between embodiment 1 and embodiment 2 is in whether the hole is provided in the armor or not. That is, embodiment 2 lacks the hole 9 provided in embodiment 1, and the antenna element 6 is completely covered with the armor 10.

Embodiment 2 is preferably used, for example, when the armor 10 is composed of a material relatively weak in mechanical strength. That is, when the mechanical strength of the material used in the armor 8 is weak, if the hole is present as in embodiment 1, the thickness of the armor is thin, and hence, the armor may be torn or other problems may be caused. Therefore, when the material of the armor 8 is weak in mechanical strength, it is preferred not to form a hole as in embodiment 2. Besides, by the constitution of embodiment 2, the antenna is less likely to be bent.

Meanwhile, in embodiment 2, the shape of the armor 10 is columnar, and its sectional shape is circular. The circular section is effective to prevent cutting of the outside part of the armor. The sectional shape of the armor 10 may be also triangular, quadrangular, polygonal, or elliptical. In the case of triangular, quadrangular or polygonal section, the antenna hardly rolls on a plane, and it is convenient for use, and hence the productivity is enhanced. By forming the armor 10 in an elliptical section, the antenna hardly rolls, and cutting of the corner is prevented.

Embodiment 3

Figure 3:
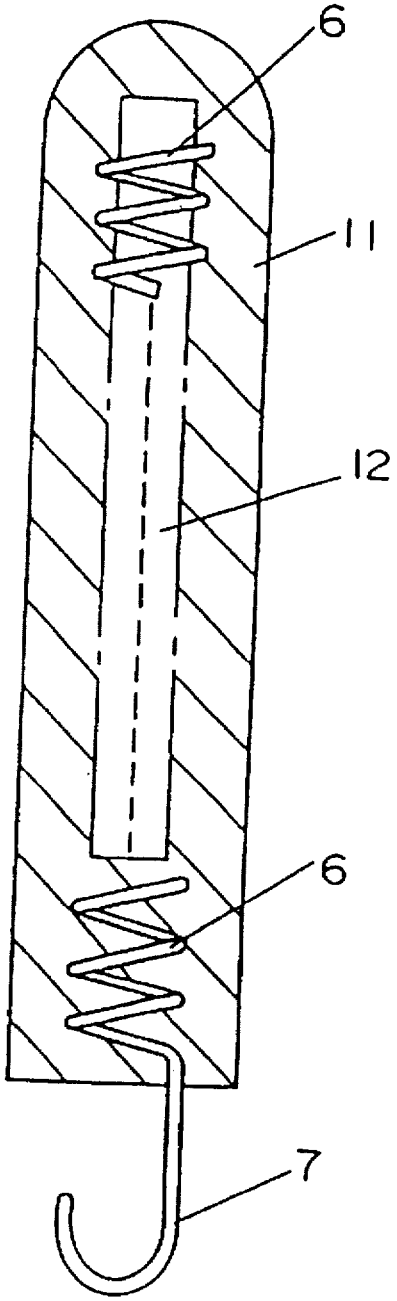
FIG. 3 is a longitudinal sectional view of a third embodiment of an antenna of the invention.

FIG. 3 is a sectional view showing an antenna in a third embodiment of the invention. In FIG. 3, the antenna comprises of an antenna element 6, and an armor 11 provided to cover the antenna element 6. The antenna element 6 has a slender, helically wound helicoid part and a hook part 7. Near the hook part 7 of the antenna element 6, excluding the armor 11, an enclosed space 12 is formed as a hollow part.

The armor 11 fixes the antenna element 6 at a position near the hook 7 of the helicoid part. The armor 11 is nonconductive, and comprises an elastic material. For example, the armor 11 is formed of a resin material, such as polyester derivative elastomer, ketone derivative resin, and polysulfone derivative resin. When polyester derivative elastomer is used as the armor 11, migration after forming is small; it does not adhere to other member; it is excellent in stability; and further, it is superior in mechanical strength. When ketone derivative resin is used as the armor 11, the heat resistance is high, and it is ideal for the antenna when used at high temperature. When polysulfone derivative resin is used as the armor 11, it excels in stability and the mechanical strength is great.

The armor 11 is formed, for example, by pouring the resin into the outer circumference of the antenna element 6, and molding.

In the embodiment, by increasing the thickness in the root portion of the armor 11 where greatest force is applied, the mechanical strength is increased. Hence, the root portion of the antenna is hardly broken or cracked. Besides, by forming the enclosed space 12, the antenna is pliable, so that the effects of external force on the antenna characteristics may be decreased.

Meanwhile, in the embodiment, the shape of the armor 11 is columnar, and its sectional shape is circular. The circular section is effective to prevent cutting of the outside part of the armor. The sectional shape of the armor 11 may be also triangular, quadrangular, polygonal, or elliptical. In the case of triangular, quadrangular or polygonal section, the antenna hardly rolls on a plane, and it is convenient for use, and hence, the productivity is enhanced. By forming the armor 11 in an elliptical section, the antenna hardly rolls, and cutting of the corner is prevented.

In the embodiment, the enclosed space 12 and outside are mutually isolated, but it is also possible to communicate between the outside and the space 12 by opening a tiny hole.

Embodiment 4

Figure 4:
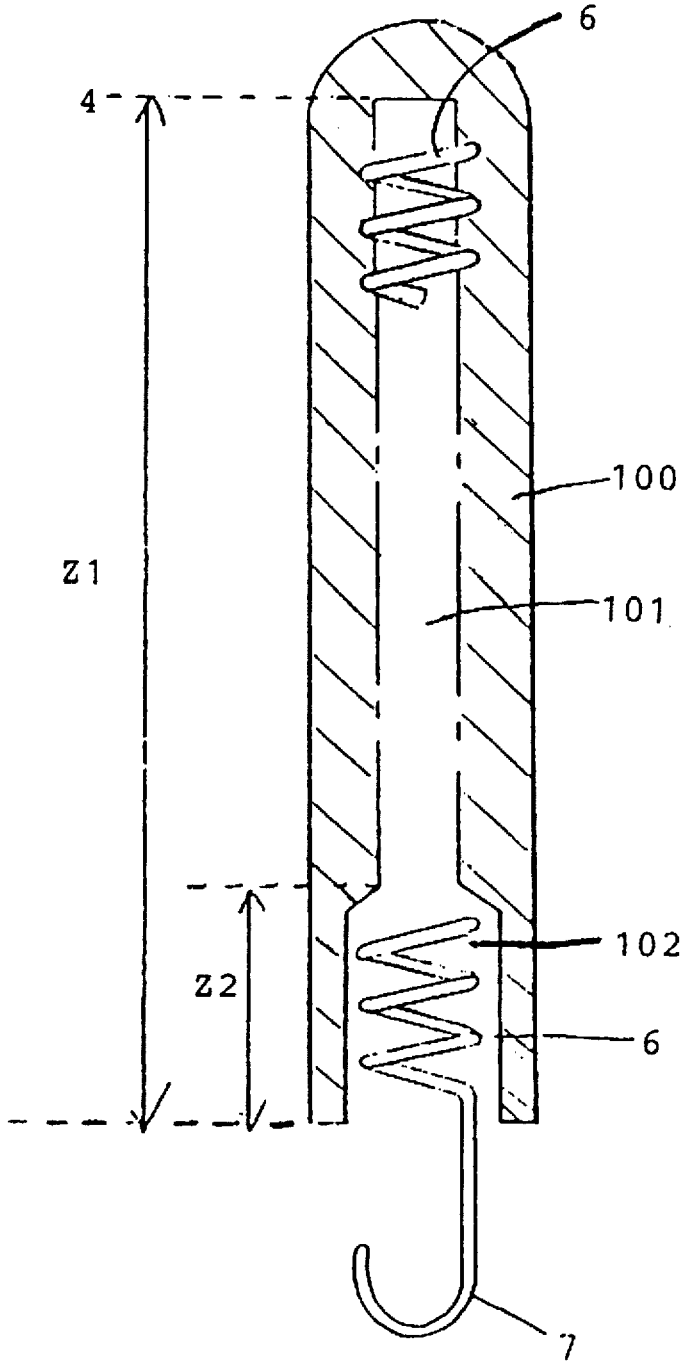
FIG. 4 is a longitudinal sectional view of a fourth embodiment of an antenna of the invention.

FIG. 4 is a sectional view showing an antenna in a fourth embodiment of the invention. In FIG. 4, the antenna comprises an antenna element 6, and an armor 100 provided to cover the antenna element 6. A hole 101 is formed inside the armor 100. The antenna element 6 comprises a helically wound helicoid part and a hook part, and is the same as the antenna element 6 shown in embodiment 1. In the armor 100 corresponding to the helicoid part near the hook part 7, an accommodating part 102 of a larger aperture than the hole 101 is formed, and the helicoid part near the hook part 7 is accommodated inside this accommodating part 102. That is, the helicoid part in the accommodating part 102 is not fixed on the armor 100. In the hole 101 excluding the accommodating part 102, the outside part of the helicoid part is fixed on the armor 100.

By thus forming the accommodating part 102, the root portion of the antenna is flexible, so that effects of external force on the antenna characteristic may be decreased.

Moreover, supposing the length of the hole 101 to be Z1 and the length of the accommodating part 102 to be Z2, it is more preferable to satisfy the relation of $$0.08\times Z1 \leq Z2 \leq 0.75\times Z1$$

In other portions that the area satisfying the above condition, the effect for enhancing the antenna characteristic is small. That is, if the length Z2 of the accommodating part 102 is less than 0.08×Z1, the effect of forming the accommodating part 102 is small, and if more than 0.75×Z1, the effect for enhancing the entire mechanical strength is small.

Figure 5:
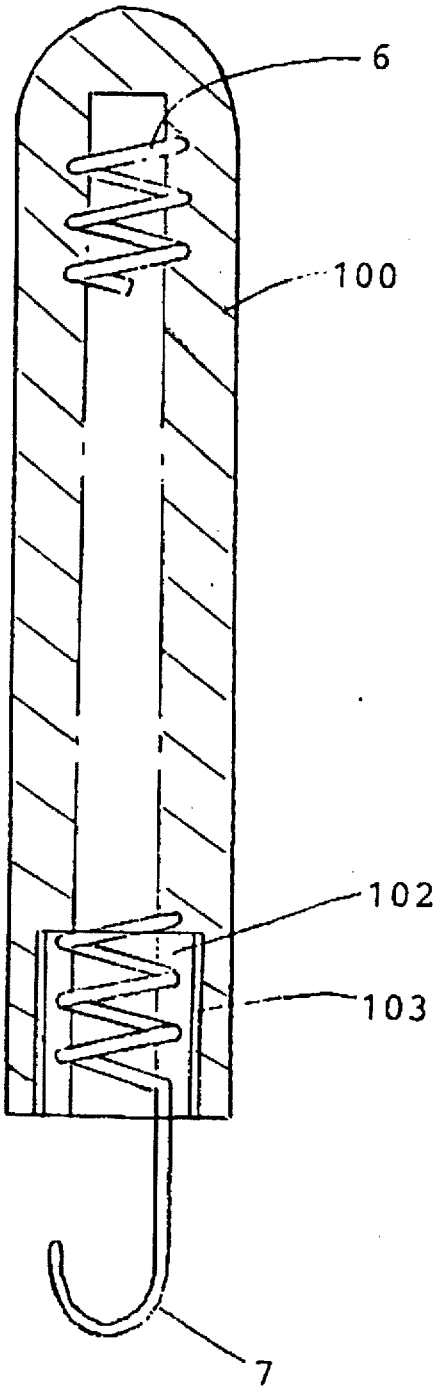
FIG. 5 is a longitudinal sectional view of another fourth embodiment of an antenna of the invention.

FIG. 5 is a sectional view of an antenna in a different constitution of the same embodiment. In FIG. 5, a reinforcing member 103 is stored inside the accommodating part 102. As the reinforcing member 103, either electric insulating material or conductive material can be used. When a conductive material is used, it must be arranged so that the antenna element 6 and reinforcing member 103 may not contact with each other. An insulating material is more preferable as the material to be used in the reinforcing member 103.

The embodiment shown in FIG. 5 is characterized by that the root portion of the antenna is hardly deflected as compared with the embodiment shown in FIG. 4. That is, by composing the reinforcing member 103 in the accommodating part 102, the root portion of the antenna is less likely to be deflected.

The armor 100 is nonconductive, and comprises an elastic material. For example, the armor 100 is formed of a resin material, such as polyester derivative elastomer, ketone derivative resin, and polysulfone derivative resin. When polyester derivative elastomer is used as the armor 100, migration after forming is small; it does not adhere to other member; is excellent in stability; and further, it is superior in mechanical strength. When ketone derivative resin is used as the armor 100, the heat resistance is high, and it is ideal for the antenna when used at high temperature. When polysulfone derivative resin is used as the armor 100, it excels in stability and the mechanical strength is great.

The armor 100 is formed, for example, by pouring the resin into the outer circumference of the antenna element 6, and molding.

In the embodiment, the shape of the armor 100 is columnar, and its sectional shape is circular. The circular section is effective to prevent cutting of the outside part of the armor. The sectional shape of the armor 100 may be also triangular, quadrangular, polygonal, or elliptical. In the case of triangular, quadrangular or polygonal section, the antenna hardly rolls on a plane, and it is convenient for use, and hence, the productivity is enhanced. By forming the armor 100 in an elliptical section, the antenna hardly rolls, and cutting of the corner is prevented.

Embodiment 5

Figure 6:
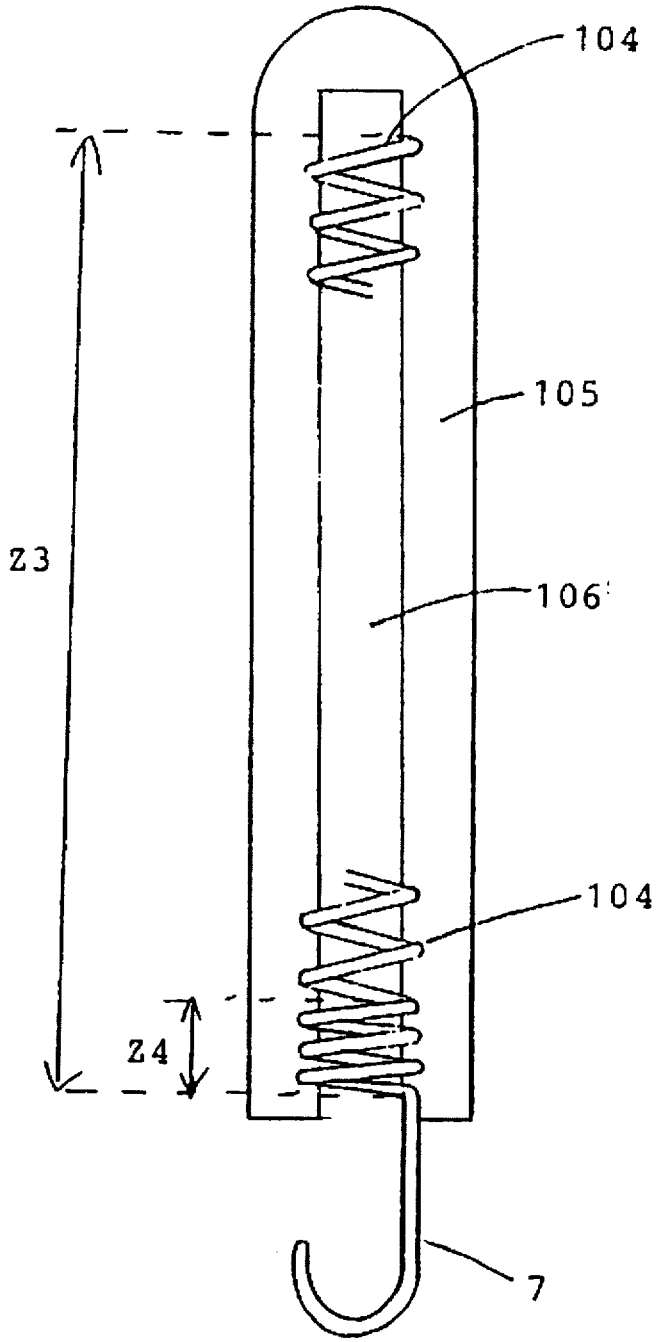
FIG. 6 is a longitudinal sectional view of a fifth embodiment of an antenna of the invention.

FIG. 6 is a sectional view showing an antenna in a fifth embodiment of the invention. In FIG. 6, the antenna comprises an antenna element 104, and an armor 105 provided to cover the antenna element 104. The antenna element 104 has a helically wound helicoid part and a hook part 7. Near the hook part 7, the coil pitch of the helicoid part is narrower than the coil pitch of the helicoid part remote from the hook part 7. A hollow part 106 is formed in the armor 105. The outside of the helicoid part is held by the armor 105. The inside of the helicoid part is hollow.

The armor 105 is nonconductive, and comprises an elastic material. For example, the armor 105 is formed of a resin material, such as polyester derivative elastomer, ketone derivative resin, and polysulfone derivative resin. When polyester derivative elastomer is used as the armor 105, migration after forming is small; it does not adhere to another member; it is excellent in stability; and further, it is superior in mechanical strength. When ketone derivative resin is used as the armor 105, the heat resistance is high, and it is ideal for the antenna when used at high temperature. When polysulfone derivative resin is used as the armor 105, it excels in stability and the mechanical strength is great.

The armor 105 is formed, for example, by pouring the resin into the outer circumference of the helicoid part, and molding.

Thus, by forming a root portion differing in the winding density from other portions, in the helicoid part of the antenna element 104, the antenna itself is less likely to deflect, and hence the strength is further increased.

Moreover, supposing the length of the helicoid part of the antenna element 104 to be Z3 and the length of the helicoid part of higher winding density out of the entire helicoid part to be Z4, it is preferred to satisfy the relation:

$$0.05 \times Z3 \leqq Z4 \leqq 0.5 \times Z3$$

Outside the scope of this relation, there is little effect for enhancing the antenna characteristic. For example, if Z4 is less than 0.05×Z3, the effect of winding tightly is smaller, and if more than 0.5×Z3, the effect for enhancing the electric characteristic of antenna is small.

Meanwhile, in the embodiment, the shape of the armor 105 is columnar, and its sectional shape is circular. The circular section is effective to prevent cutting of the outside part of the armor. The sectional shape of the armor 105 may be also triangular, quadrangular, polygonal, or elliptical. In the case of triangular, quadrangular or polygonal section, the antenna hardly rolls on a plane, and it is convenient for use, and hence, the productivity is enhanced. By forming the armor 105 in an elliptical section, the antenna hardly rolls, and cut of the corner is prevented.

Practical Experimental Examples

Further specific experimental examples are described below.

Using SWP-B of 1 mm in diameter as wire material (a kind of piano wire, JIS listed, steel-piano-wire butt welding), the wire material was wound in a coil, and an antenna element was fabricated in a coil diameter (CK) of 5 mm by 13 turns, with the hook length of 16 mm, coil length (CL) of 30 mm, and 12 turns.

The armor was made of polyester derivative elastomer (tradename HYTREL of Toray-DuPont), and a cylindrical armor (outside diameter 8 mm, length 50 mm) with a hollow part (inside diameter 2.5 mm, length 45 mm) was fabricated. Thus, the helical antenna as shown in FIGS. 1*a* and 1*b* was fabricated.

The central part of the helical antenna was deflected 2,000 times by about 90 degrees. Afterwards, the characteristics of the helical antenna were measured, including the natural frequency, resonance frequency, band, gain, and VSWR (voltage standing wave ratio). As a result, the characteristics were same as the performance before deflection test, and there was no deterioration in characteristics.

By contrast, using the conventional antenna shown in FIGS. 13*a*, 13*b*, the same deflection test was conducted, and the antenna characteristics were measured before and after the test, and the characteristics were found to be altered significantly.

Manufacturing Method

Embodiments of manufacturing method of the antenna of the invention are described below.

Figure 7:
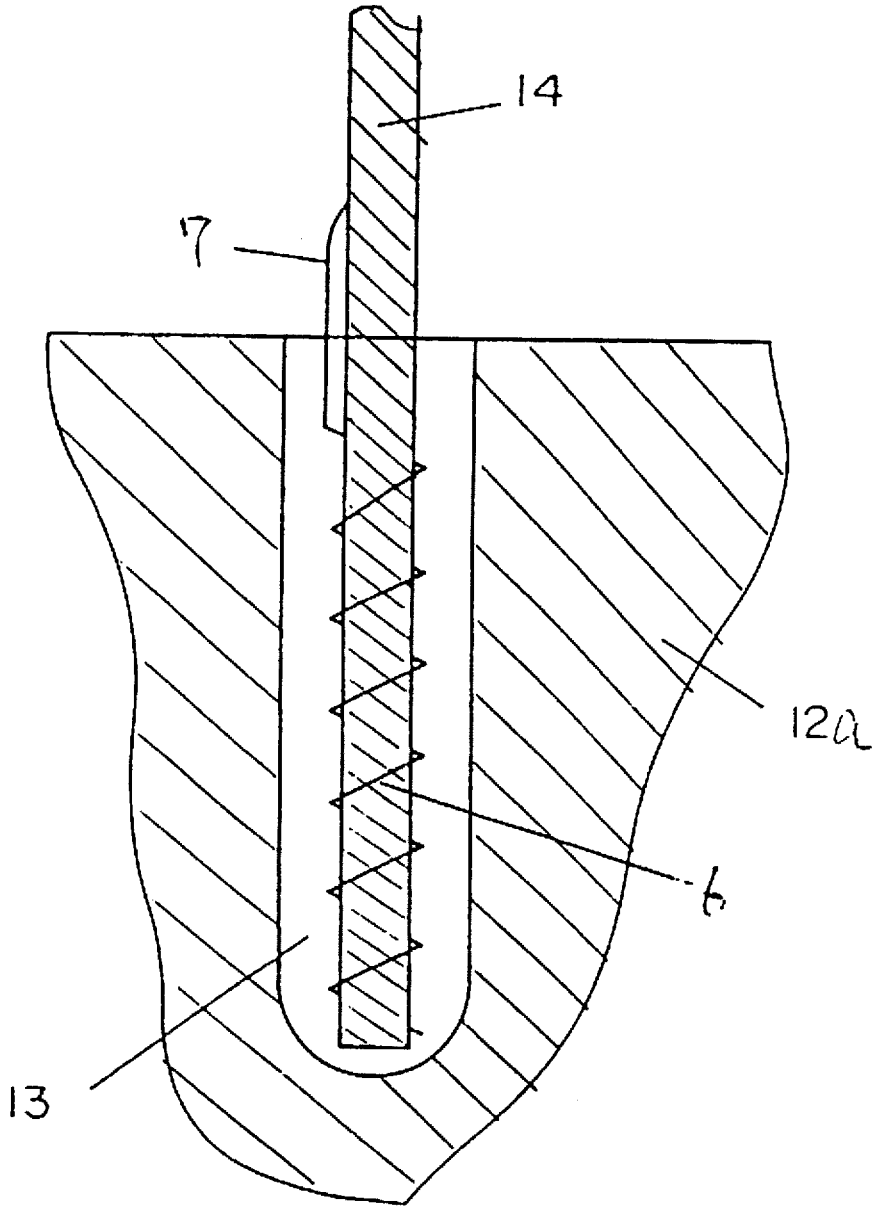
FIG. 7 is a side sectional view explaining a manufacturing method of an antenna of the invention.

FIG. 7 is a side sectional view showing a first embodiment of manufacturing method of the antenna of the invention. In FIG. 7, a cavity 13, with the same outside diameter and shape as a desired armor, is formed in a die 12*a*. First, in the cavity 13, an antenna element 6 wound around a bar-shaped die 14 is inserted. The antenna element 6 has a hook part 7, and a helically wound helicoid part. Next, in the cavity 13, a resin (not shown), as the material for the armor is poured, and the resin is solidified to fabricate the armor 8. At this time, the helicoid part of the antenna element 6 is fixed to the armor 8. Then, the bar-shaped die 14 having the armor 8 and antenna element 6 is drawn out of the cavity 13. Finally, the bar-shaped die 14 is pulled out of the antenna element 6 fixed to the armor 8. Thus, the antenna as shown in FIG. 1*a* is fabricated.

Figure 8:
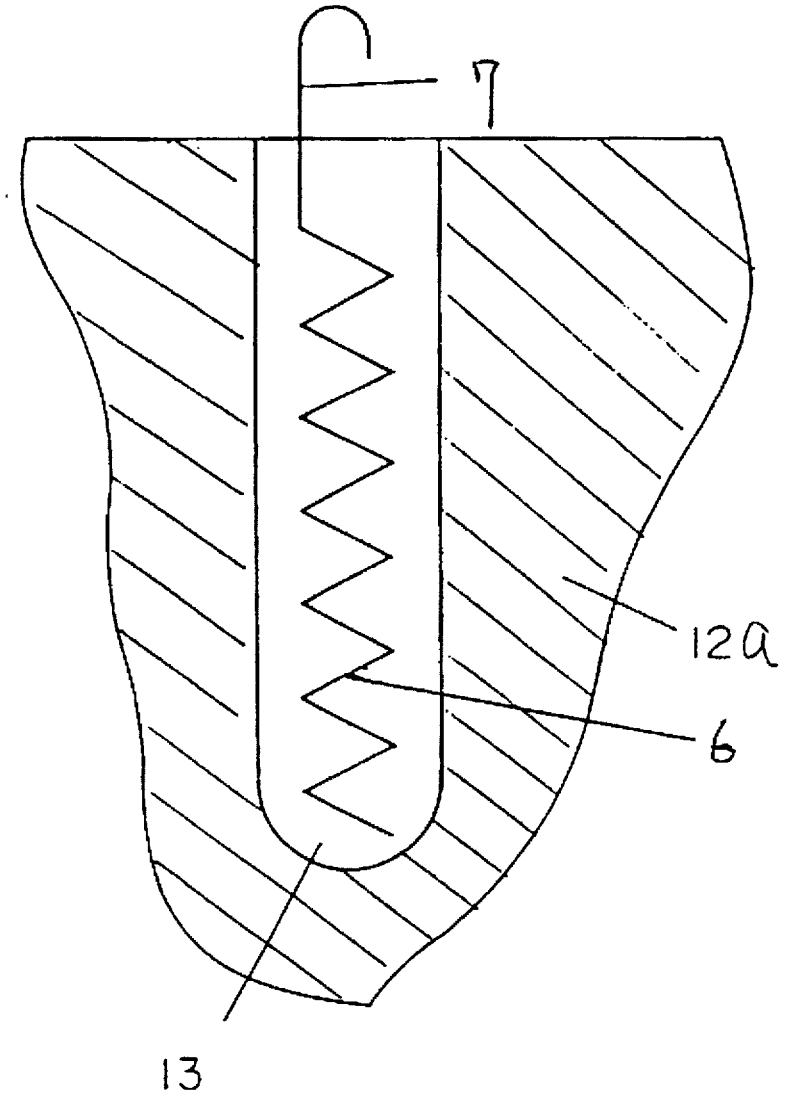
FIG. 8 is a side sectional view explaining another manufacturing method of an antenna of the invention.

FIG. 8 is a side sectional view showing a second embodiment of manufacturing method of the antenna of the invention. In FIG. 8, the antenna element 6 comprises a hook part 7 and a helically wound helicoid part. First, only the helicoid part is inserted into a die 12*a*. Then, a resin (not shown), as material for the armor is poured into a cavity 13, and the resin is solidified to fabricate the armor 8. At this time, the entire helicoid part is fixed in the armor 8. Then, the antenna element 6 fixing the arbor 8 is pulled out of the cavity 13. Thus, the antenna as shown in FIGS. 2*a* and 2*b* is fabricated.

Figure 9:
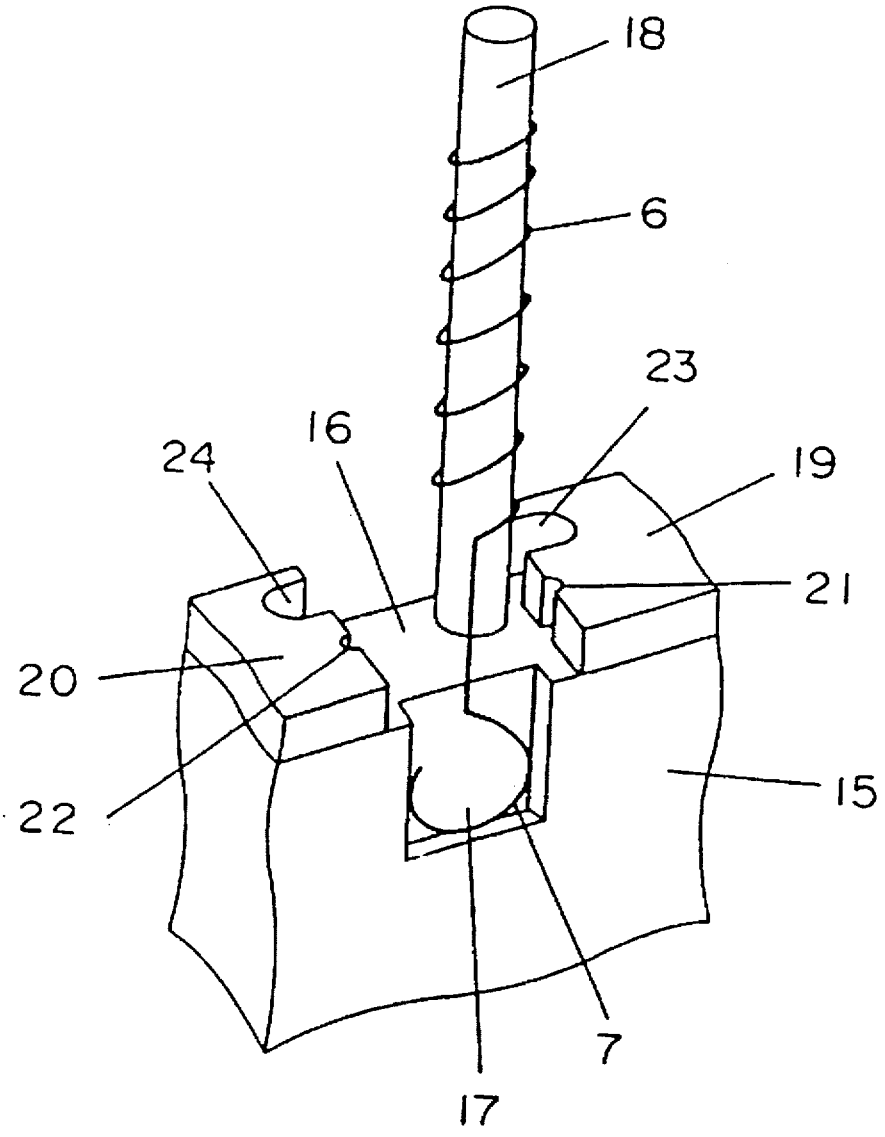
FIG. 9 is a side sectional view explaining a different manufacturing method of an antenna of the invention.
Figure 10:
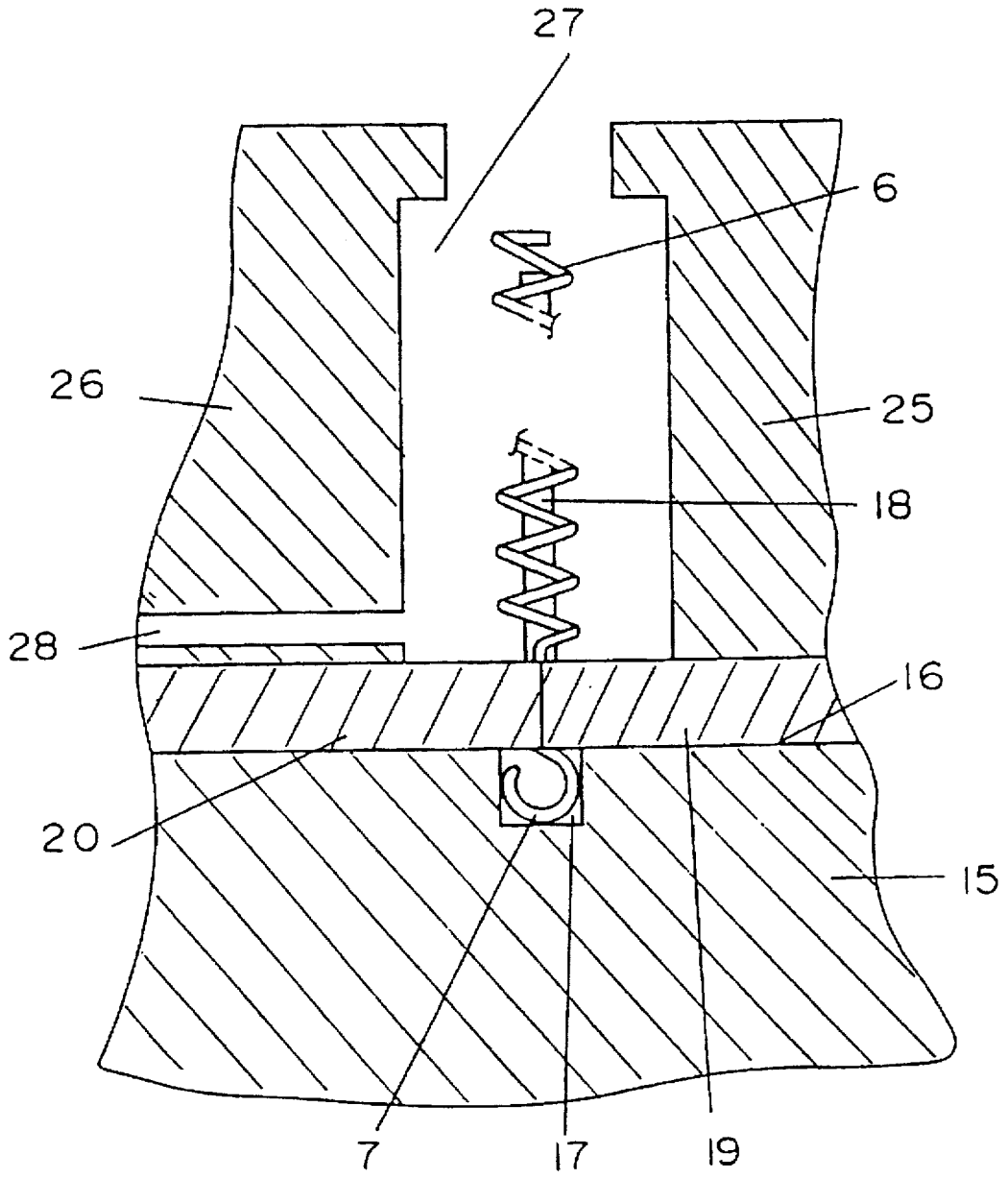
FIG. 10 is a side view of FIG. 9.

FIG. 9 and FIG. 10 are a perspective view and a side view, respectively showing a third embodiment of manufacturing method of the antenna of the invention. In FIG. 9 and FIG. 10, a slide plane 16 is formed on the top surface of a base 15. A recess 17 reaching the slide plane 16 is provided in the side surface of the base 15. A post 18 is erected on the slide plane 16. The antenna element 6 comprises a hook part 7 and a helically wound helicoid part. First, the helicoid part wound around the post 18 and the hook 7 are mounted on the base 15. In this case, the hook part 7 is fitted into the recess 17. Two holding members 19, 20 are mounted on the slide plane 16 to slide thereon. In the confronting portions of the holding member 19 and holding member 20, grooves 21, 22 and grooves 23, 24 are provided respectively.

Therefore, as shown in FIG. 10, by joining the holding member 19 and holding member 20 butt to butt, the antenna element 6 is put in between the groove 21 and groove 22, while the post 18 is placed between the groove 23 and groove 24. In this state, a die 25 and a die 26 are joined butt to butt. At this time, a penetration hole 27 is formed, and the post 18 and antenna element 6 are stored in the penetration hole 27. The slide plane 16 side opening of the penetration hole 27 is completely clogged by the sliding plane 16.

Next, a resin or the like (not shown) is poured into the penetration hole 27 from a pour hole 28 provided beneath the die 26 to fill the penetration hole 27 with the resin, and the resin is solidified. Finally, by removing the die 25 and the die 26, the antenna as shown in FIGS. 1*a* and 1*b* is fabricated. In this manufacturing method, the defect of inclined fixing of the antenna element 6 in the armor 8 is eliminated, so that the antenna having stable characteristics may be obtained.

A radiotelephone using the antenna of the invention is described below.

Figure 11:
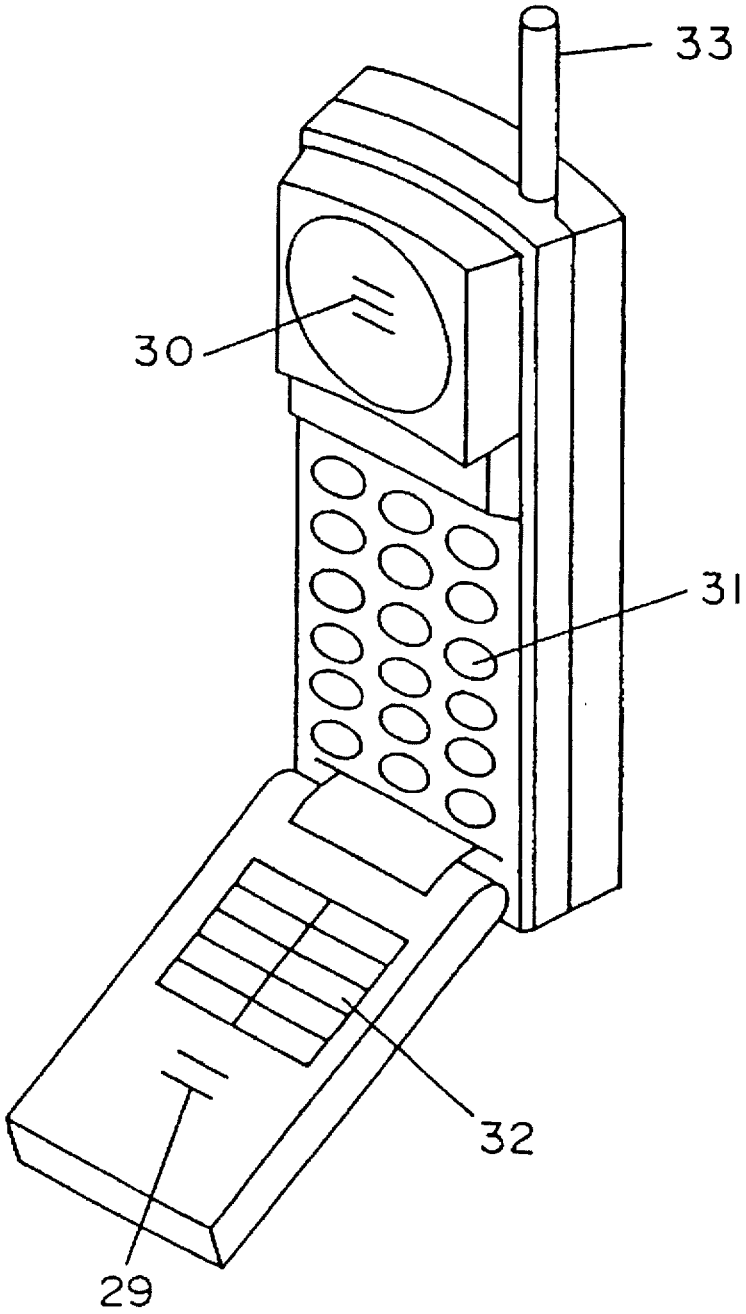
FIG. 11 is a perspective view showing an embodiment of a radiotelephone of the invention.
Figure 12:
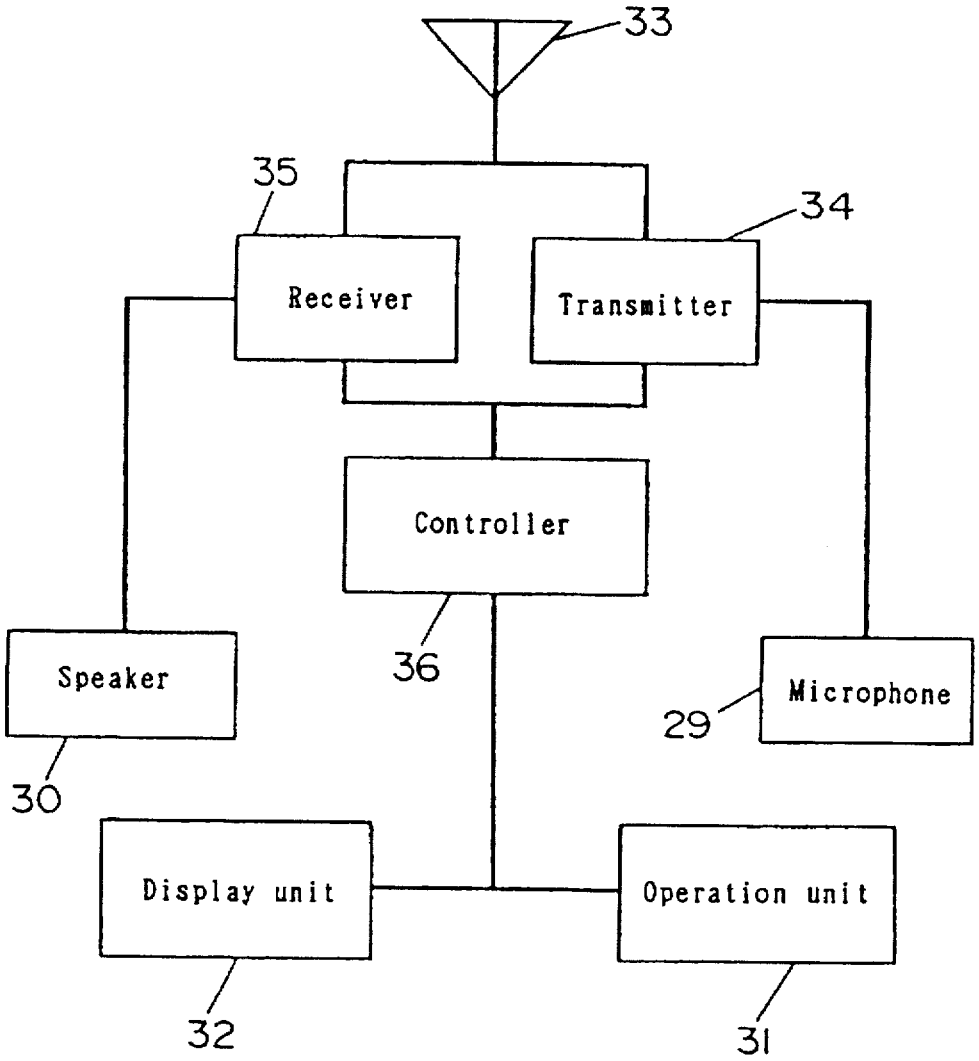
FIG. 12 is a block diagram showing an embodiment of a radiotelephone of the invention.

FIG. 11 and FIG. 12 are a perspective view and a block diagram, respectively showing an embodiment of a radiotelephone of the invention.

In FIG. 11 and FIG. 12, a radiotelephone is composed of a microphone 29 for converting voice into a voice signal, a speaker 30 for converting the voice signal back to voice, an operation unit 31 comprising dial buttons and others, a display unit 32 displaying incoming and others, an antenna 33 according to any one of the first to fifth embodiments, and a transmitter 34 for demodulating the voice signal from the microphone 29 and converting into a send signal. The send signal fabricated in the transmitter 34 is released to outside through the antenna 33. In a receiver 35 for converting the received signal received by the antenna 33 to a voice signal, the voice signal produced in the receiver 35 is converted into voice by the speaker 30. A controller 36 controls the transmitter 34, receiver 35, operation unit 31, and display unit 32.

In this way, by using the antenna of the embodiment in the radiotelephone, the antenna characteristics are not changed if an impact is applied to the apparatus itself or the antenna is deflected. Therefore, the radiotelephone can received the receive signal at a fixed level, and noise is not generated in the voice.

Besides, since the send signal can be also transmitted at a fixed level, the signal output or S/N ratio is not impaired.

As described herein, the antenna of the invention, if deflected or exposed to impact, can prevent deformation of the antenna element. As a result, the antenna characteristics are not changed.

Moreover, the radiotelephone using the antenna of the invention can receive the receive signal at a specific level, a noise-free voice can be obtained.

Of course, it would be understood that a wide range of changes and modifications can be made to the preferred embodiments described above. It is therefor intended that the foregoing detailed description be understood that it is the following claims, including equivalents, which are intended to define the scope of the invention.

What is claimed is:

1. An antenna for a radio telephone comprising:

an antenna element having a helicoid part and a J-shaped hook part for mounting said antenna element to a radio telephone, said helicoid part and J-shaped hook part formed from an integral wire having a predetermined length; and an armor having one portion covering and holding a part of said helicoid part to said armor, and another portion covering and accommodating another part of said helicoid part, said another part located between said hook part and a part of said helicoid part, wherein said another part of said helicoid part is not held by said armor and remains flexible, wherein said one portion of armor covering and holding a part of said helicoid part to said armor and said another portion of armor covering and accommodating another part of said helicoid part have a total length Z1, wherein said another portion of armor covering and accommodating said another part of said helicoid part has a length Z2, wherein the respective lengths of said armor satisfy the relationship of $0.08*Z1 \leqq Z2 \leqq 0.75*Z1$, wherein the length of said J-shaped hook part determines an input impedance of said antenna element, and wherein said J-shaped hook part forms an uncovered end of the antenna element for attachment to said radio telephone.

2. An antenna for a radio telephone comprising:

an antenna element having a helicoid part and a J-shaped hook part for mounting said antenna element to a radio telephone, said helicoid part and J-shaped hook part formed from an integral wire having a predetermined length; and an armor having one portion covering and holding a part of said helicoid part to said armor, and another portion covering and accommodating another part of said helicoid part, said another part located between said hook part and a part of said helicoid part, wherein said another part of said helicoid part is not held by said armor and remains flexible, wherein a winding density of the helicoid part adjacent to the hook part is higher than a winding density of a remaining part of said helicoid part, wherein said helicoid part has a length Z3, wherein said helicoid part having a higher winding density has a length Z4, wherein the respective lengths of said helicoid part satisfy the relationship of $0.05*Z3 \leqq Z4 \leqq 0.5*Z3$, wherein the length of said J-shaped hook part determines an input impedance of said antenna element, and wherein said J-shaped hook part forms an uncovered end of the antenna element for attachment to said radio telephone.

* * * * *